US011006707B2

(12) United States Patent
Ferron

(10) Patent No.: US 11,006,707 B2
(45) Date of Patent: May 18, 2021

(54) STRING-TYPE JEWELRY HAVING SNAP-FIT SEGMENTS

(71) Applicant: Tangerine Creative, LLC, Kansas City, MO (US)

(72) Inventor: Robert William Ferron, Kansas City, MO (US)

(73) Assignee: Tangerine Creative, LLC, Kansas City, MO (US)

( * ) Notice: Subject to any disclaimer, the term of this patent is extended or adjusted under 35 U.S.C. 154(b) by 0 days.

(21) Appl. No.: 16/562,268

(22) Filed: Sep. 5, 2019

(65) Prior Publication Data

US 2020/0077755 A1 Mar. 12, 2020

Related U.S. Application Data

(60) Provisional application No. 62/727,818, filed on Sep. 6, 2018.

(51) Int. Cl.
*A44C 15/00* (2006.01)
*A44C 25/00* (2006.01)

(52) U.S. Cl.
CPC ..... *A44C 25/007* (2013.01); *A44C 15/0045* (2013.01)

(58) Field of Classification Search
CPC . A44C 25/007; A44C 15/0045; A44C 15/005; A44C 15/006; A44C 15/0075; A44C 15/0085; A44C 15/009; A44C 13/00; A44C 17/0216; A44C 17/0225; A44C 17/0233
USPC ..... 63/23
See application file for complete search history.

(56) References Cited

U.S. PATENT DOCUMENTS 7,150,141 B1 * 12/2006 Greenway ..... A44C 11/002 59/1
9,408,442 B1 * 8/2016 Terry ..... A44C 25/007
2014/0283551 A1 * 9/2014 Ciprari ..... A44C 25/007 63/43
2015/0089975 A1 * 4/2015 Paleschuck ..... G09F 23/00 63/1.13

FOREIGN PATENT DOCUMENTS

CH 676914 A5 * 3/1991 ..... A44C 13/00

OTHER PUBLICATIONS

Pandora,Pandora Reflections Mesh Bracelets, Charm Bracelets; (Downloaded Jan. 22, 2020) available at https://us.pandora.net/en/charm-bracelets/pandora-reflections.

(Continued)

*Primary Examiner* — Jack W Lavinder
(74) *Attorney, Agent, or Firm* — Hovey Williams LLP

(57) ABSTRACT

A jewelry assembly includes an elongated support and a plurality of charms. Each charm is removably attachable to the support by a snap-fit connection comprising attachment and clip parts, with one of the parts being associated with the support and the other of the parts being associated with the charm. The clip part includes a pair of opposed clip arms that present an open slot and a neck with a gap having a narrower cross-sectional dimension than the slot. The attachment part is received in the slot and has a cross-sectional dimension greater than the gap of the neck. At least one of the attachment and clip parts is flexible so as to flex as the attachment part passes through the neck into the slot.

18 Claims, 11 Drawing Sheets

(56) References Cited

OTHER PUBLICATIONS

GlobeNewswire, Inc.; "Pandora Launches New Bracelet Concept"; (dated Oct. 4, 2018) available at https://www.globenewswire.com/news-release/2018/10/04/1601157/0/en/PANDORA-LAUNCHES-NEW-BRACELET-CONCEPT.html.

* cited by examiner

STRING-TYPE JEWELRY HAVING SNAP-FIT SEGMENTS

CROSS-REFERENCE TO RELATED APPLICATIONS

This application claims the priority benefit of U.S. Provisional Application Ser. No. 62/727,818 filed Sep. 6, 2018, entitled STRING-TYPE JEWELRY HAVING SNAP-FIT SEGMENTS, which is hereby incorporated in its entirety by reference herein.

BACKGROUND

1. Field

The present invention relates generally to jewelry and related accessories. In particular, embodiments of the present invention concern a jewelry assembly with a support and charms attached by a snap-fit connection.

2. Discussion of Prior Art

Bracelet, necklaces, and other types of conventional jewelry are often provided with ornamental charms or pendants. Although such jewelry is provided with features that are aesthetically pleasing, some conventional jewelry has charms or pendants that are not customizable by the user. Other known jewelry items include selectively attachable charms or pendants. The charm or pendant generally includes a mechanical clasp with multiple discrete clasp components that are assembled and shiftably attached to each other.

These conventional jewelry items have various deficiencies. For instance, jewelry with conventional mechanical clasps can be damaged such that the jewelry is not functional. In particular, mechanical clasps are prone to excessive wear and damage, such that the clasp may be difficult or impossible to operate. Prior art attachable charms and pendants are also known as being particularly unwieldy and expensive to manufacture.

This background discussion is intended to provide information related to the present invention which is not necessarily prior art.

SUMMARY

The following brief summary is provided to indicate the nature of the subject matter disclosed herein. While certain aspects of the present invention are described below, the summary is not intended to limit the scope of the present invention.

Embodiments of the present invention provide a jewelry assembly that does not suffer from the problems and limitations of prior art devices, including those problems set forth above.

A first aspect of the present invention concerns a jewelry assembly that broadly includes an elongated support and a plurality of charms. Each of the charms is removably attachable to the support by a snap-fit connection comprising attachment and clip parts, with one of the parts being associated with the support and the other of the parts being associated with the charm. The clip part includes a pair of opposed clip arms that present an open slot and a neck with a gap having a narrower cross-sectional dimension than the slot. The attachment part is received in the slot and has a cross-sectional dimension greater than the gap of the neck, with at least one of the attachment and clip parts being flexible so as to flex as the attachment part passes through the neck into the slot.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Preferred embodiments of the invention are described in detail below with reference to the attached drawing figures, wherein.

Figure 5:
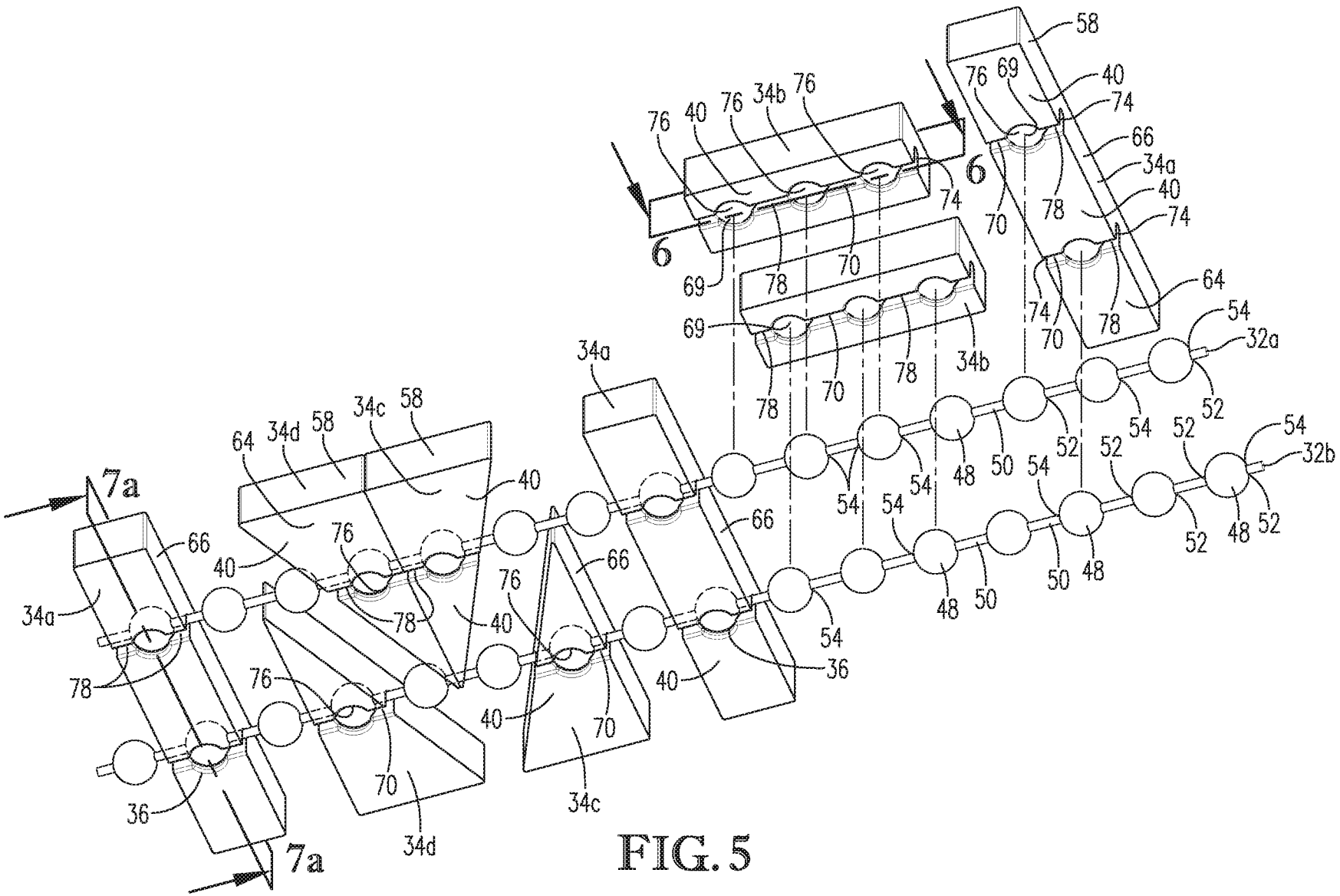
FIG. 5 is a fragmentary rear perspective of the jewelry assembly shown in FIGS. 1-4, showing snap-fit connections comprising attachment parts and clip parts, with the attachment parts being associated with the supports and the clip parts being associated with the charms.
Figure 7A:
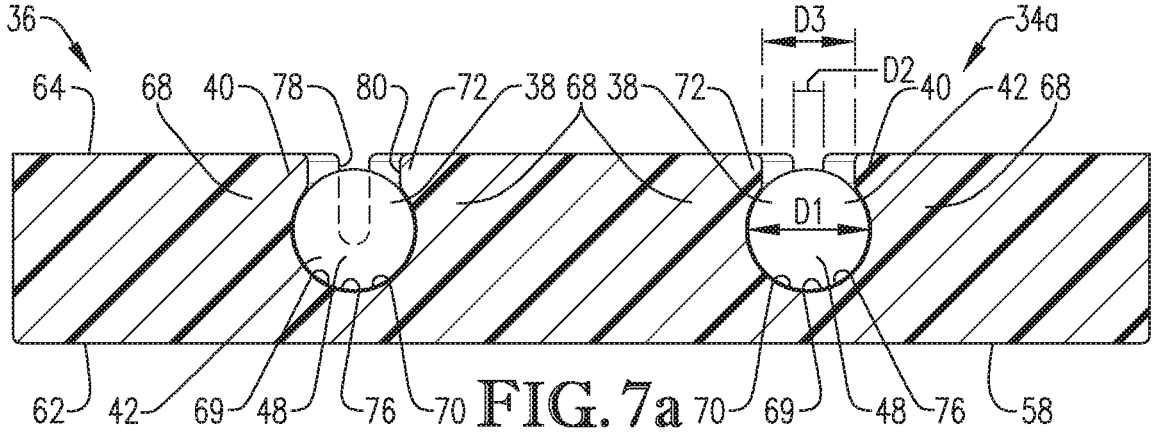
Figure 7B:
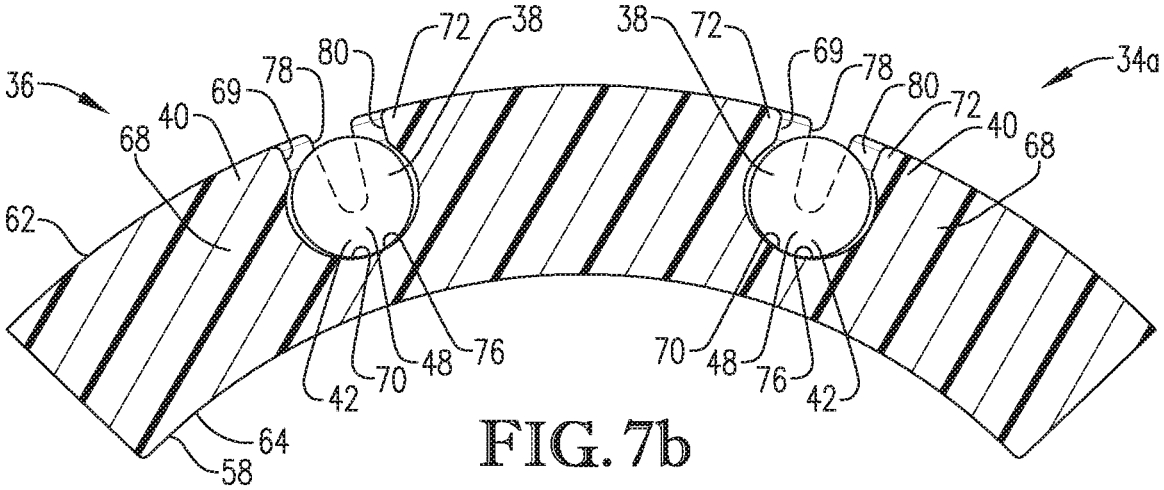
Figure 8:
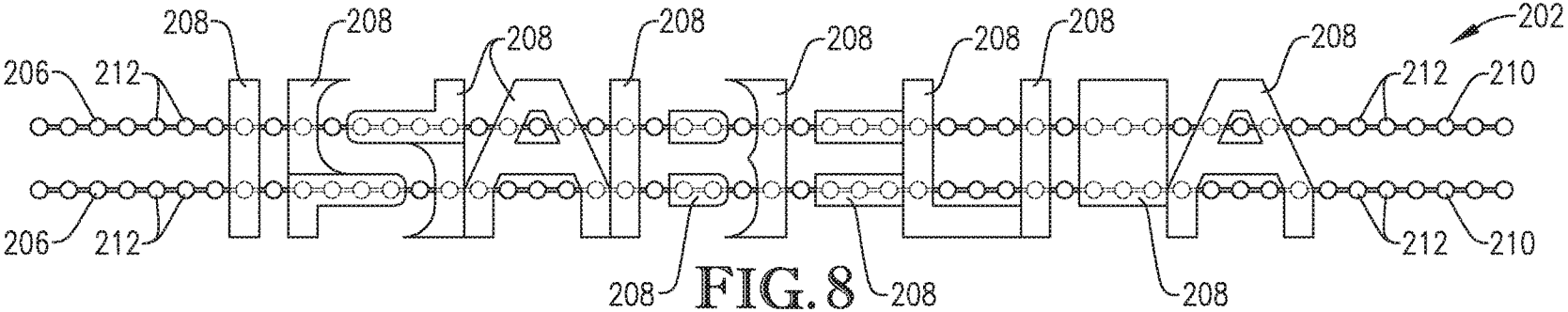
Figure 9:
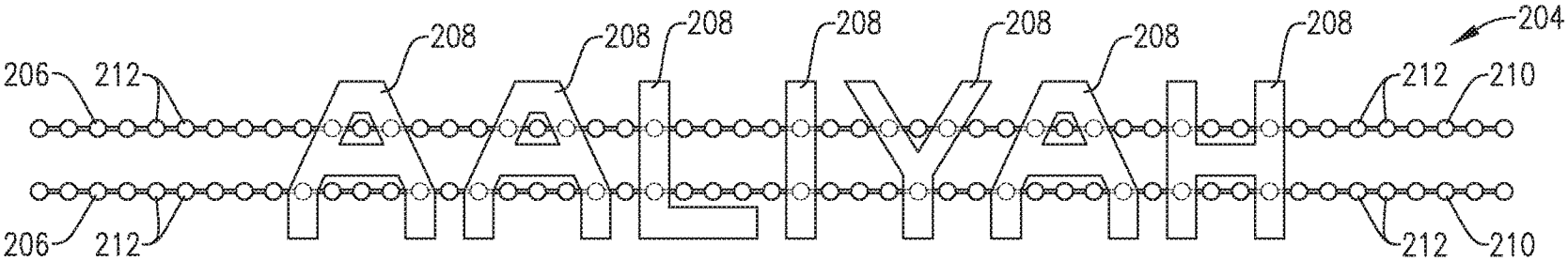
Figure 10:
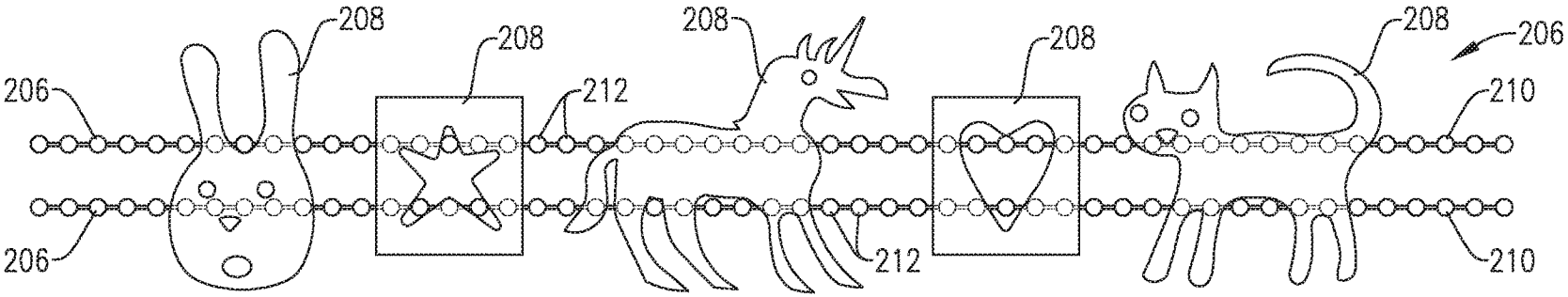
Figure 11:
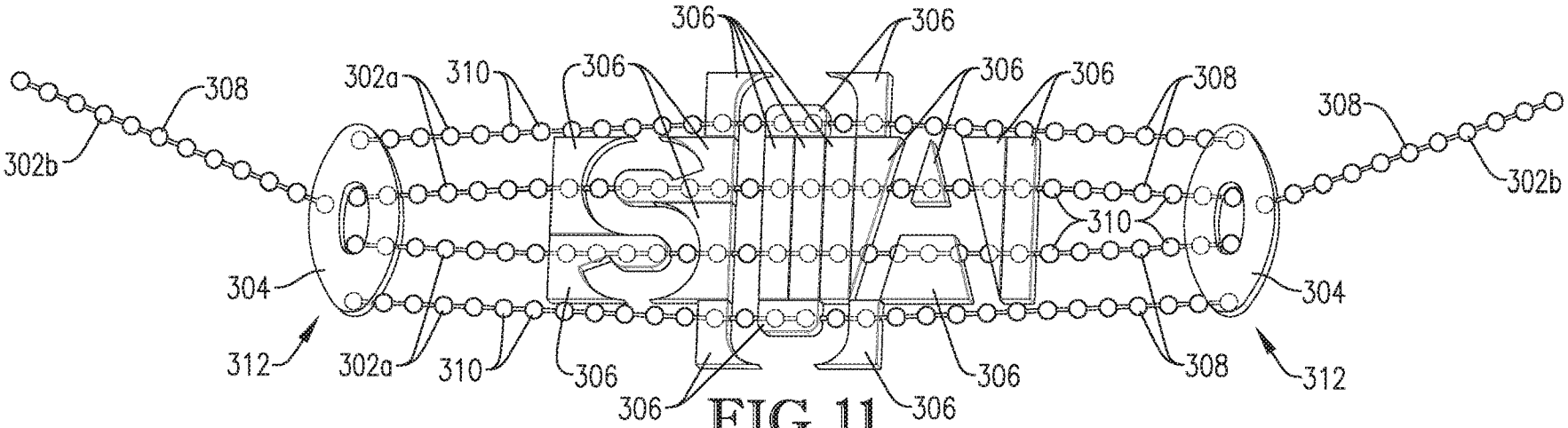
Figure 12:
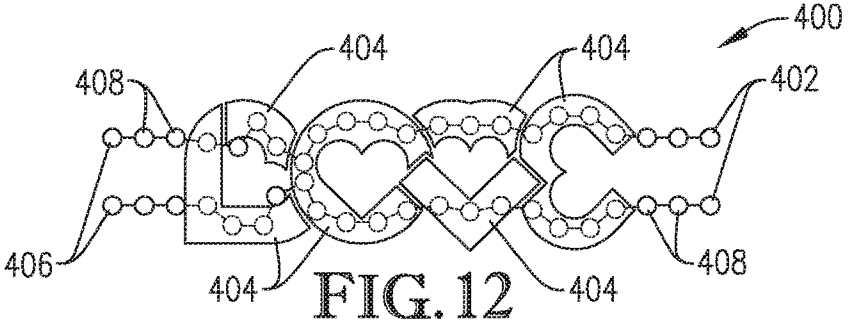
Figure 13:
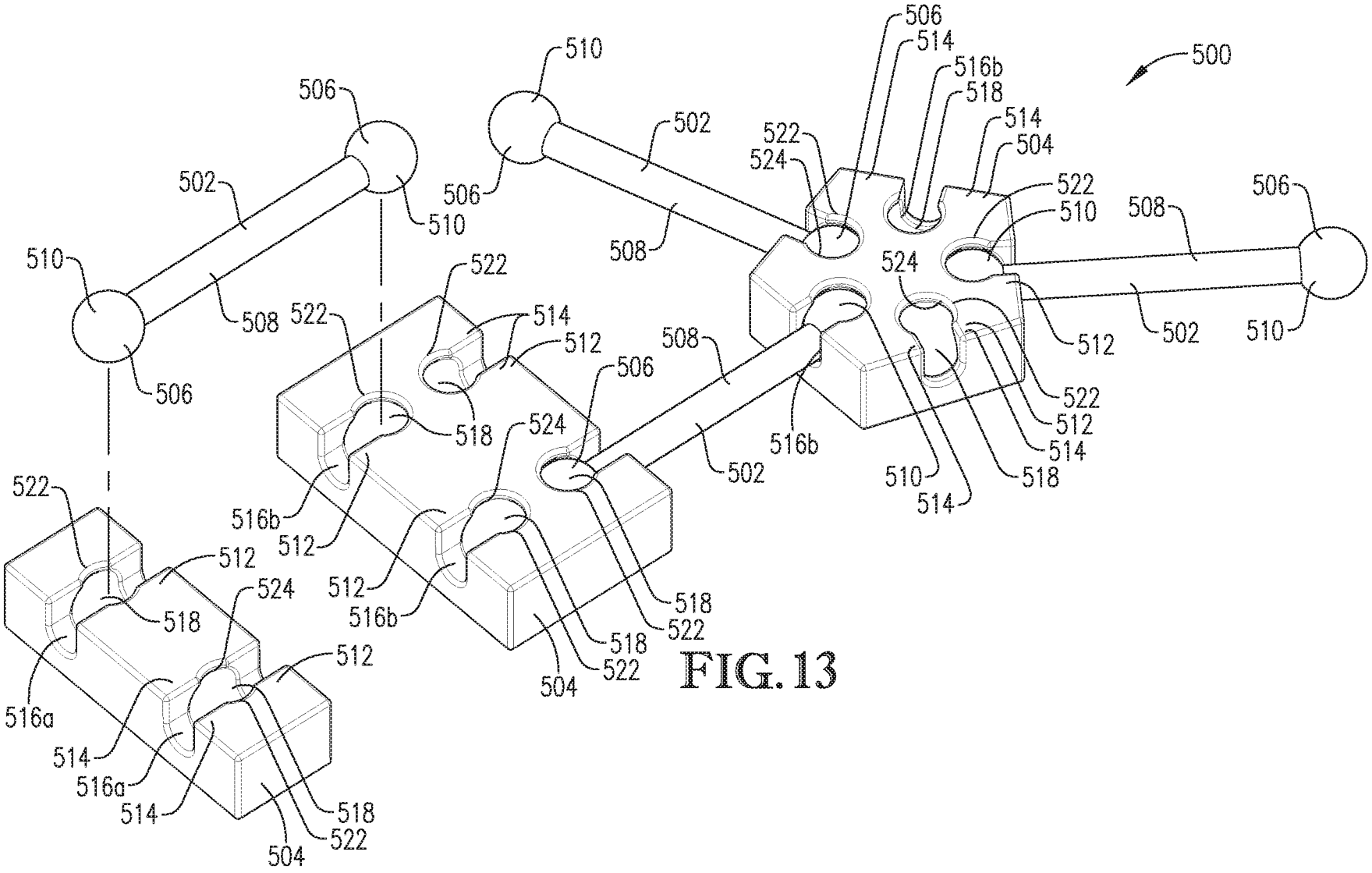
Figure 15:
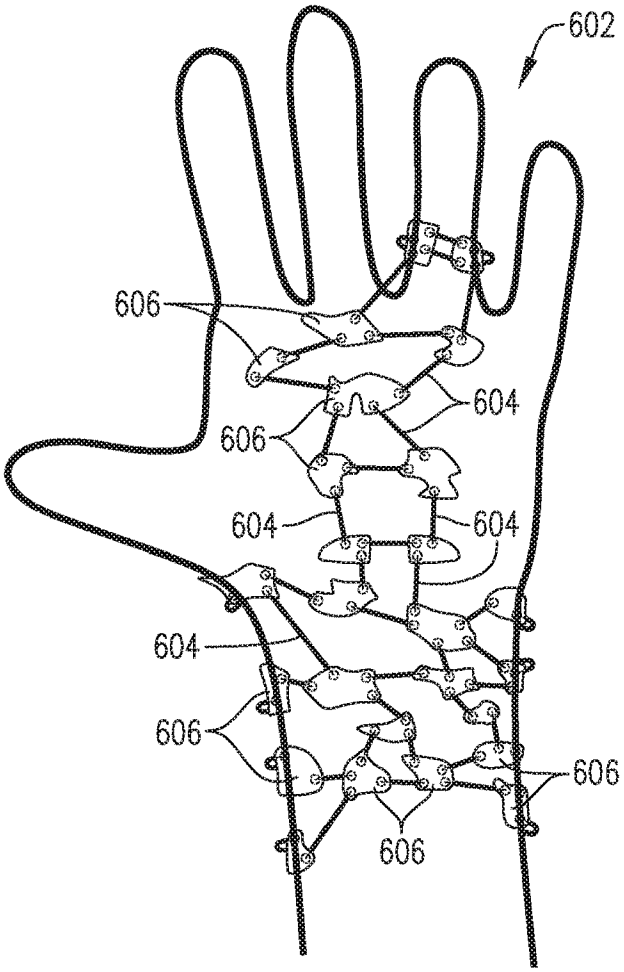
Figure 14:
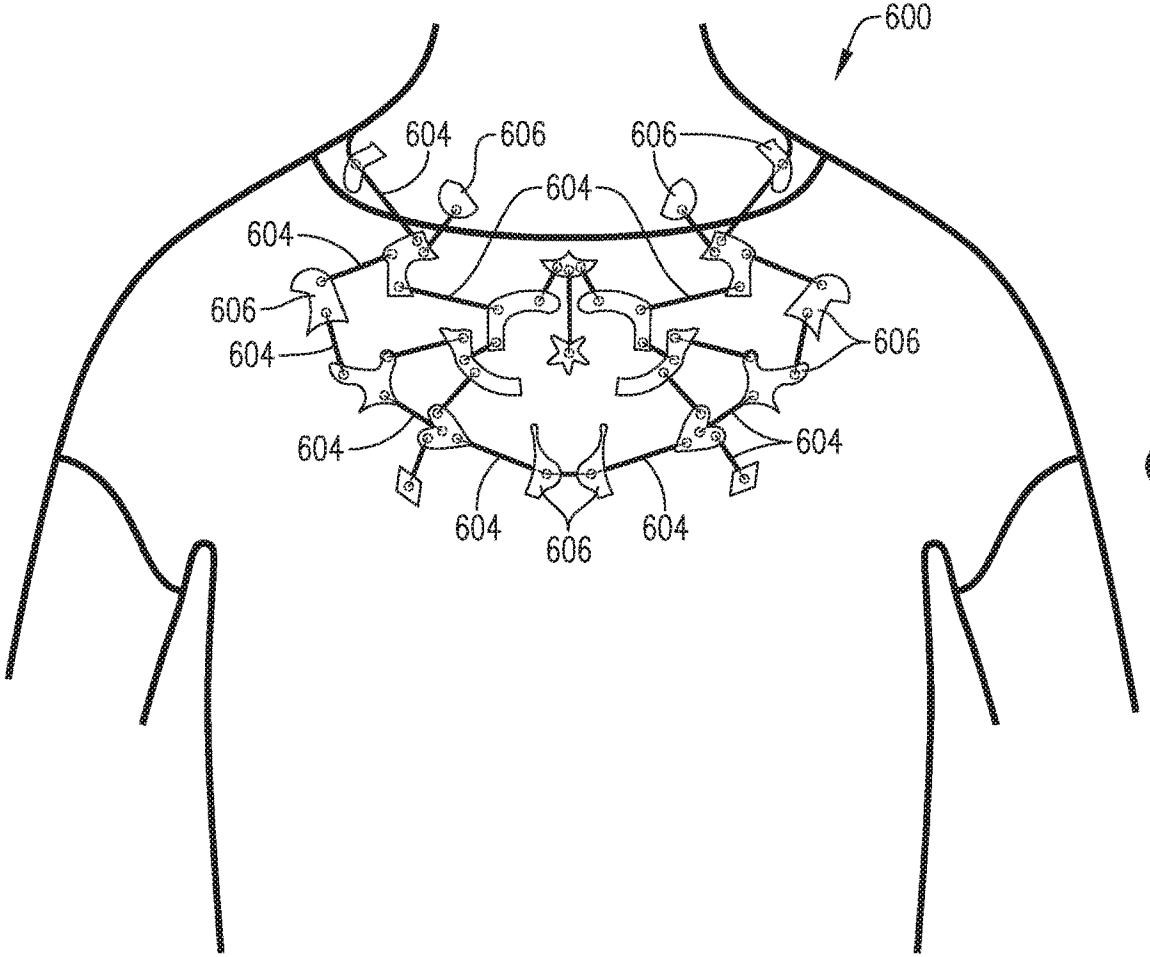
Figure 16:
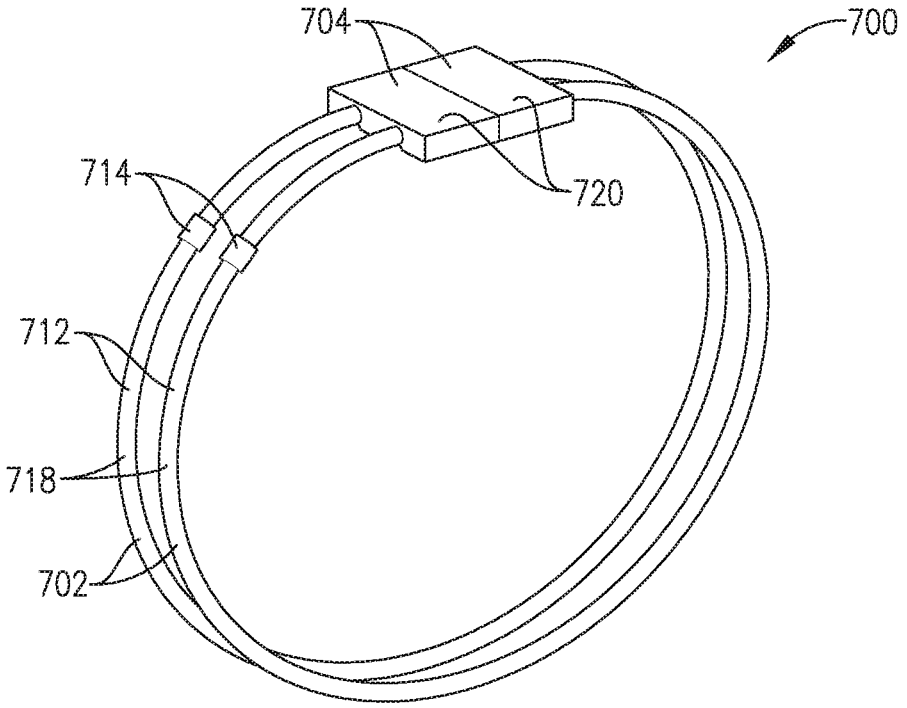
Figure 17:
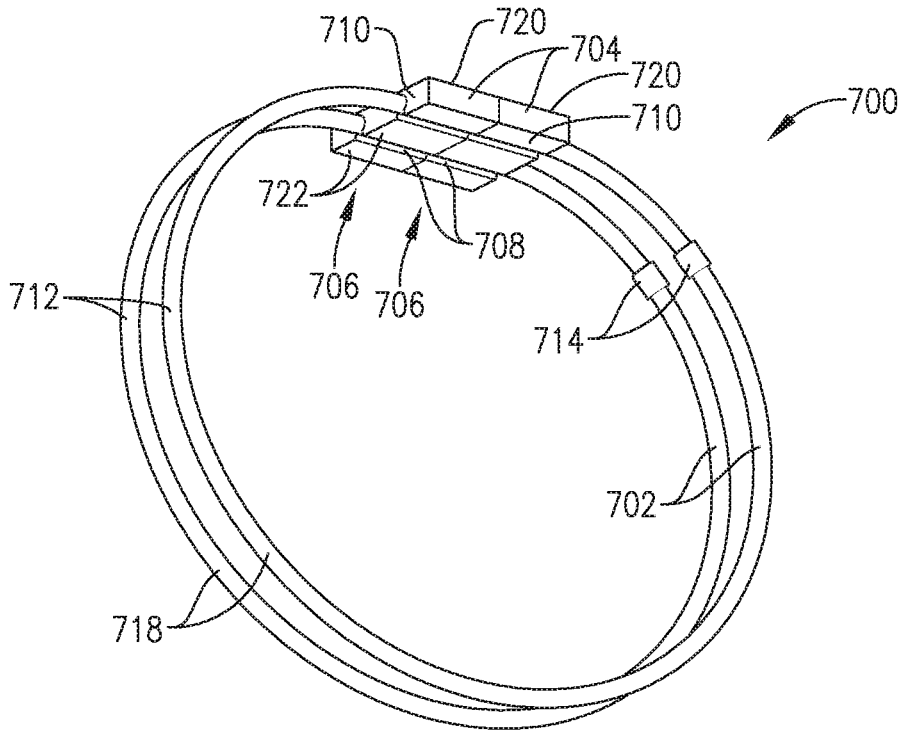
Figure 18:
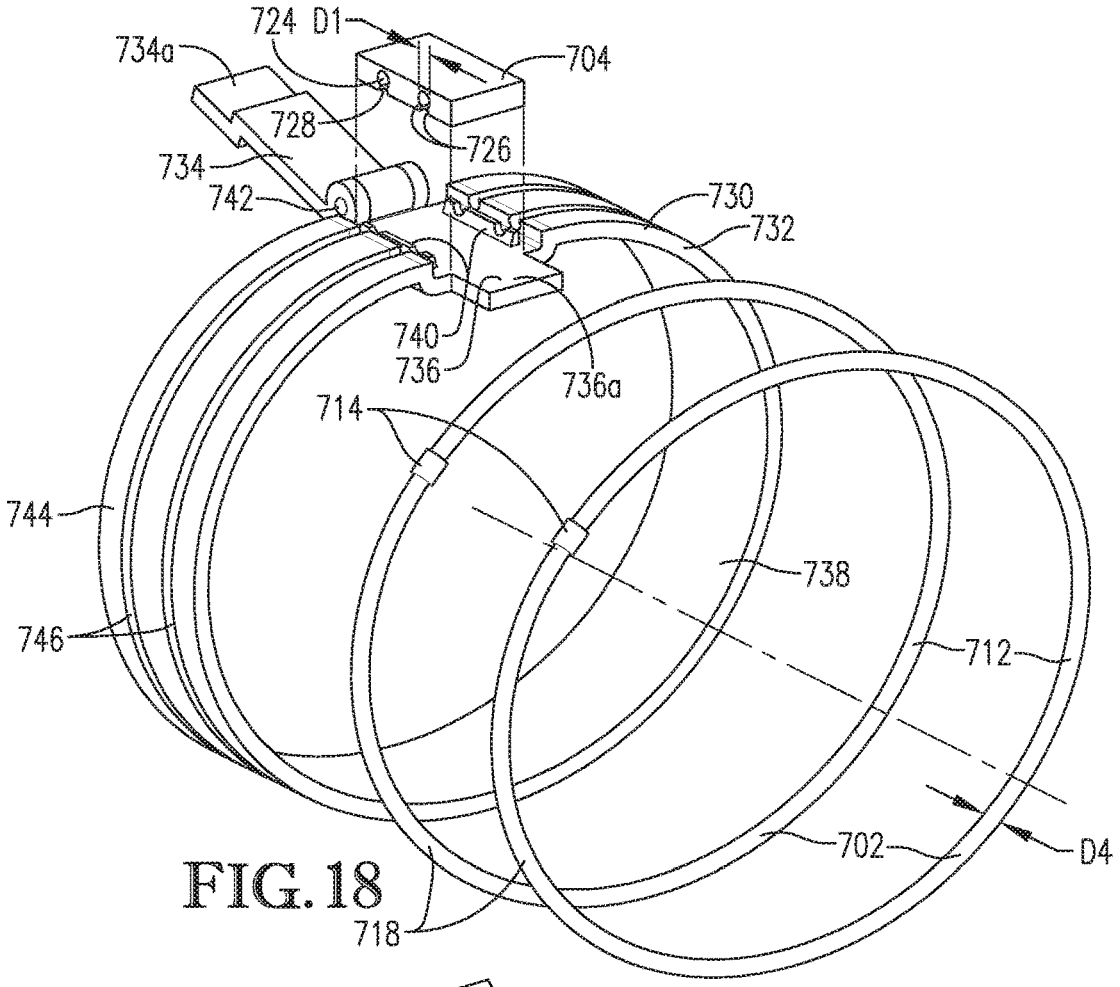
Figure 19:
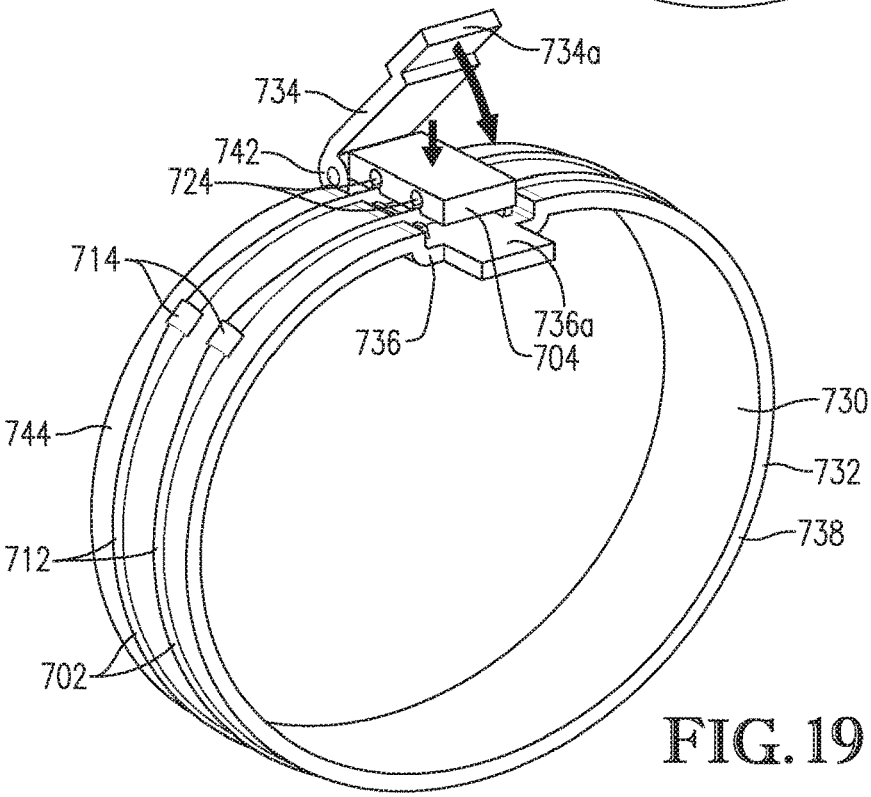
Figure 20:
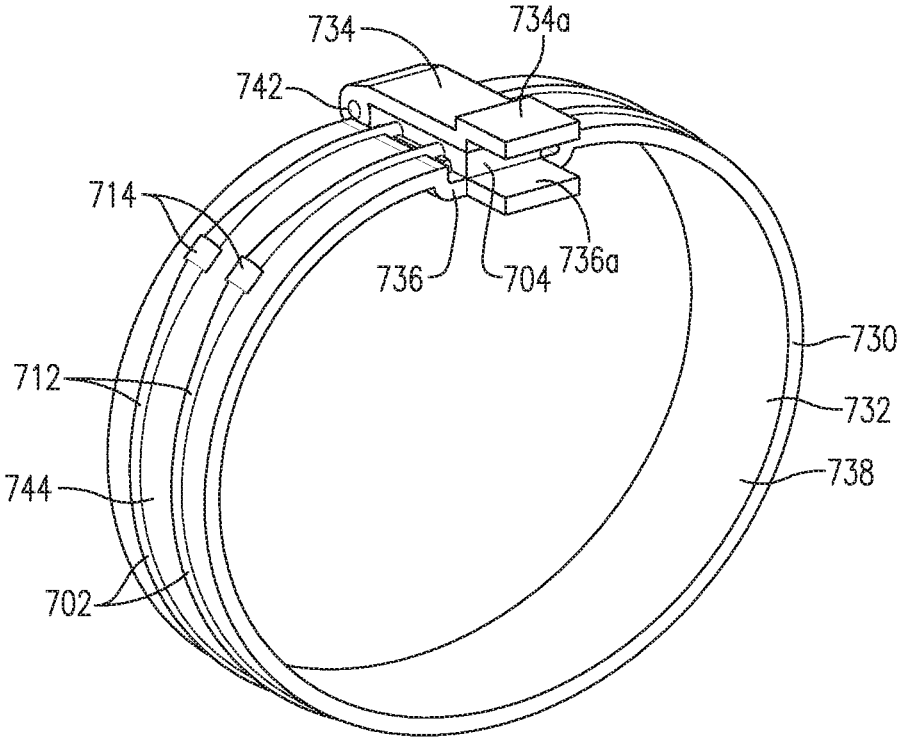
Figure 21:
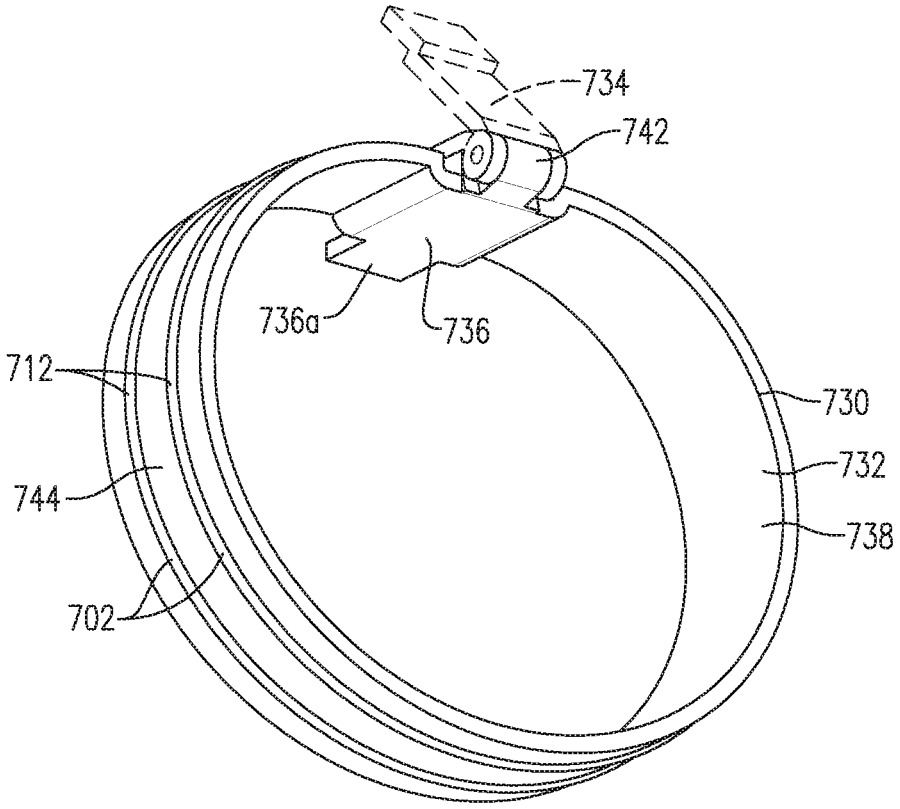

FIG. 7*a* is a cross section of another one of the charms and the supports taken along line 7*a*-7*a* in FIG. 5, showing the supports removably received by the slots;

FIG. 7*b* is a cross section of the charm and supports shown in FIG. 7*a*, but showing the charm flexed to enlarge the slots and necks;

FIGS. 8-10 are front elevations of alternative jewelry assemblies, with each jewelry assembly including a pair of supports and a plurality of charms, each being attached to one or more of the supports by snap-fit connections;

FIG. 11 is a front elevation of an alternative jewelry assembly, showing a pair of support connectors, four supports attached to a plurality of charms and extending between the support connectors, and a pair of supports extending from the support connectors to provide extensions configured to wrap around a wearer's neck;

FIG. 12 is a front elevation of an alternative jewelry assembly, showing a pair of supports and a plurality of charms attached to each other by snap-fit connections;

FIGS. 13-15 are perspective views of alternative jewelry assemblies, showing discrete ball supports interconnecting adjacent charms, and with the ball supports being indirectly attached to one another by the charms;

FIG. 16 is an upper perspective of an alternative jewelry assembly, including elastic bands and charms attached to each other by snap-fit connections;

FIG. 17 is a lower perspective of the jewelry assembly shown in FIG. 16;

FIG. 18 is an upper perspective of the jewelry assembly shown in FIGS. 16 and 17, with the elastic bands and charms being exploded, showing a charm attachment device for attaching the charms to the bands, with the device including a tray and a lever hinged to the tray;

FIG. 19 is an upper perspective of the jewelry assembly and the charm attachment device similar to FIG. 18, but showing the elastic bands mounted on the tray and one of the charms located above the bands;

FIG. 20 is an upper perspective of the jewelry assembly and the charm attachment device similar to FIG. 19, but showing the lever swung closed to snap the charm onto the bands; and FIG. 21 is a lower perspective of the jewelry assembly and the charm attachment device similar to FIG. 20, but taken from the opposite side.

The drawing figures do not limit the present invention to the specific embodiments disclosed and described herein. While the drawings do not necessarily provide exact dimensions or tolerances for the illustrated components or structures, the drawings, not including any purely schematic drawings, are to scale with respect to the relationships between the components of the structures illustrated therein.

DETAILED DESCRIPTION OF THE PREFERRED EMBODIMENTS

Turning to FIGS. 1-7*b*, a jewelry assembly 30 is configured to be assembled by a user in any of numerous customized arrangements. The depicted jewelry assembly 30 is preferably provided in the form of a bracelet. However, it is within the scope of the present invention for the jewelry assembly to take various jewelry forms (e.g., a band, necklace, anklet, strap, pendant, etc.).

As will be explained in greater detail, the jewelry assembly 30 includes elongated supports 32*a,b* and a plurality of charms 34*a-f*. The jewelry assembly 30 is preferably configured so that the charms 34 cooperatively provide indicia 35.

Each charm 34 is removably attachable to the supports 32 by a snap-fit connection 36 (see FIGS. 5 and 7*a*). Each snap-fit connection 36 preferably includes an attachment part 38 and a clip part 40 (see FIG. 7*a*). As will be explained, in the illustrated embodiment, the attachment parts 38 are associated with the supports 32, and the clip parts 40 are associated with the charms 34.

Figure 1:
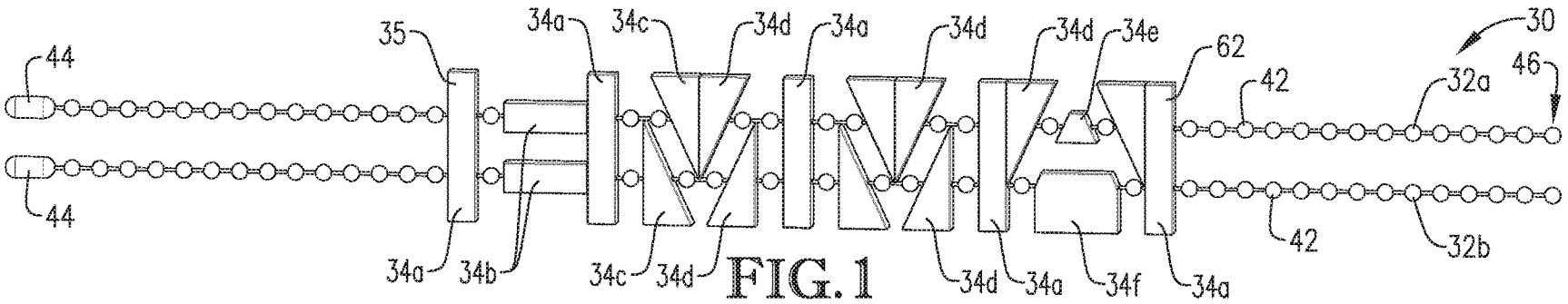
FIG. 1 is a front perspective of a jewelry assembly constructed in accordance with a first preferred embodiment of the present invention, showing a pair of supports and a plurality of charms, each being attached to one or both of the supports by snap-fit connections.
Figure 2:
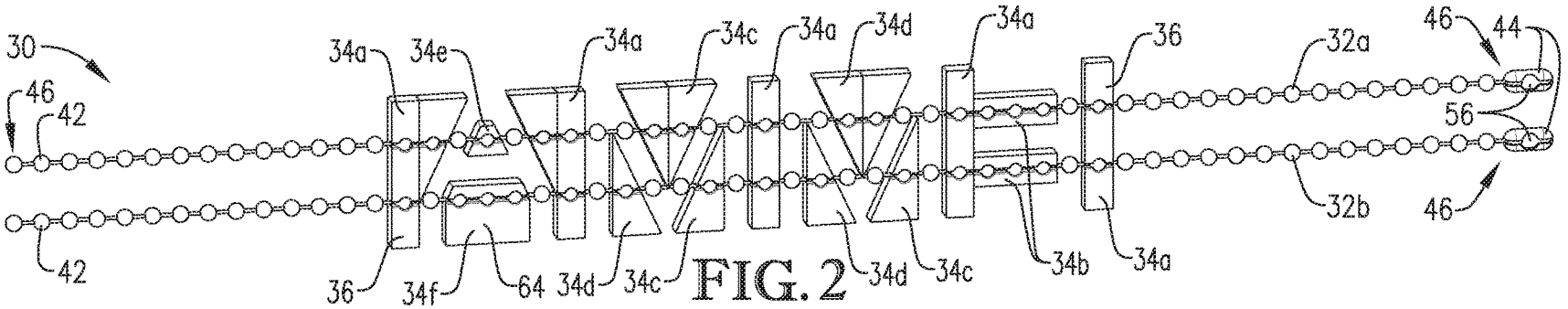
FIG. 2 is a rear perspective of the jewelry assembly shown in FIG. 1.
Figure 3:
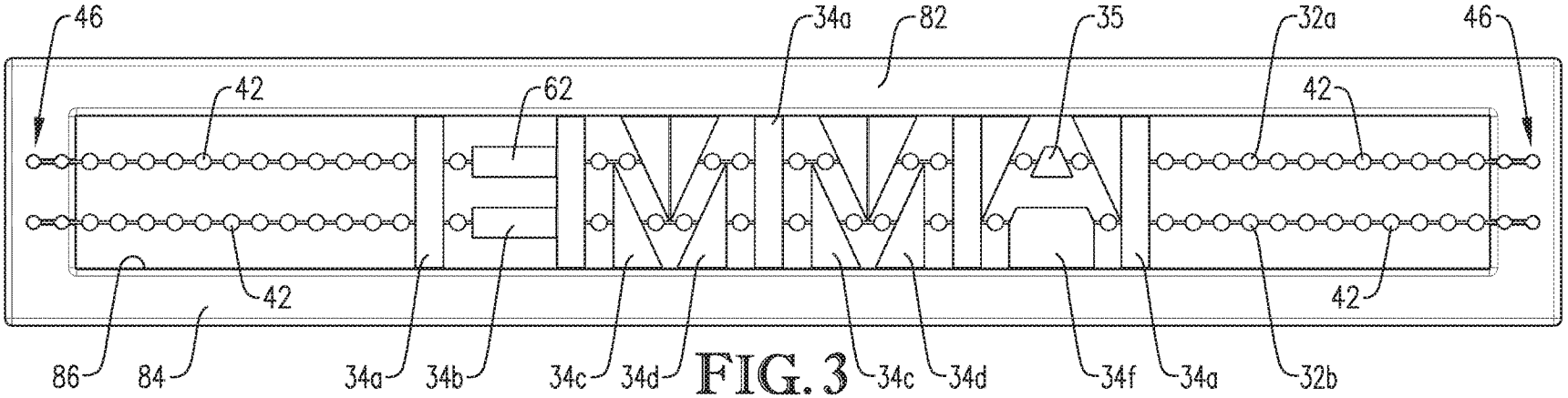
FIG. 3 is a front elevation of the jewelry assembly shown in FIGS. 1 and 2, showing the jewelry assembly mounted on a tray for assembly.
Figure 4:
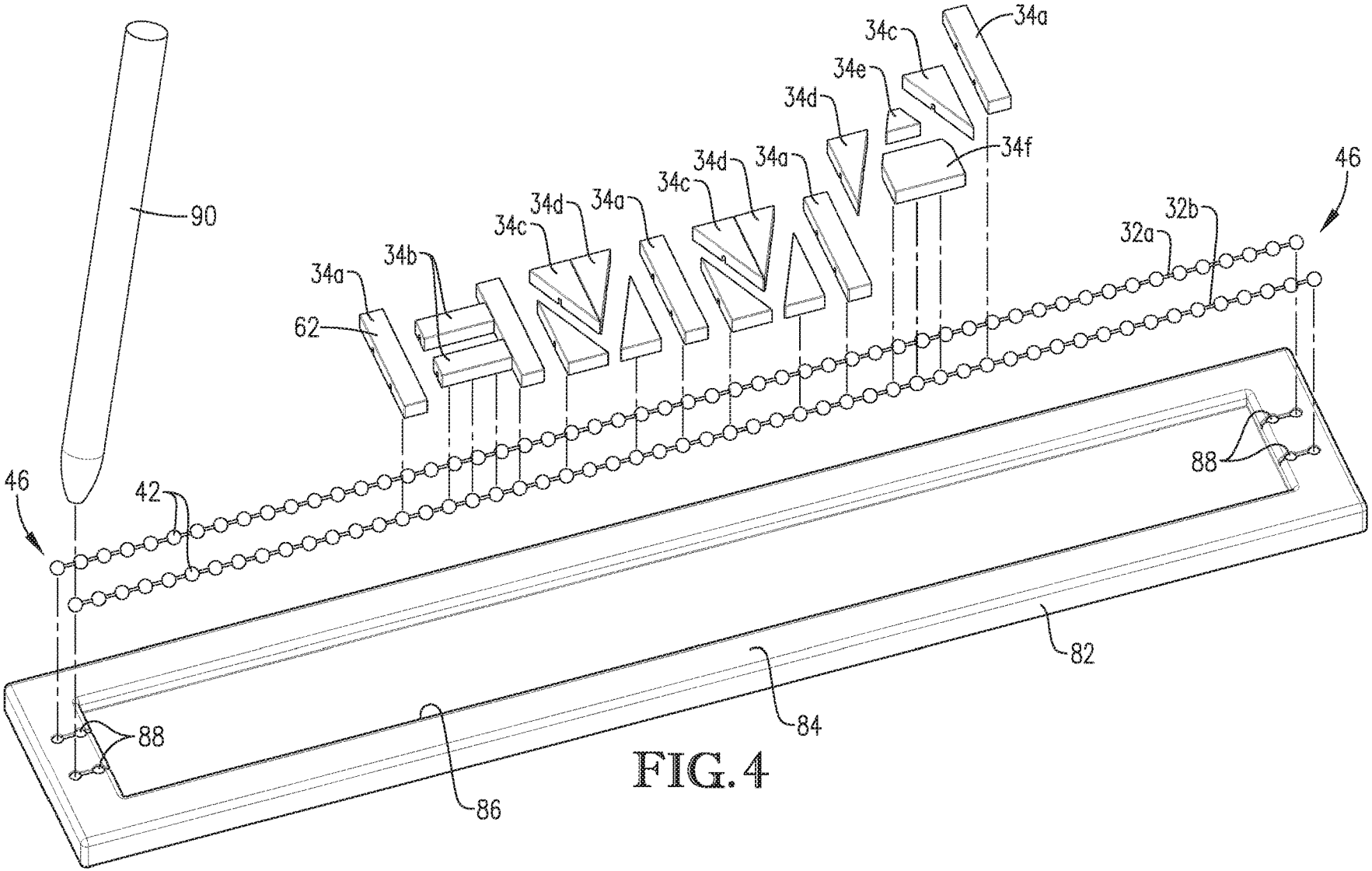
FIG. 4 is an exploded front perspective of the jewelry assembly shown in FIGS. 1-3, showing the components of the jewelry assembly located in proximity to the tray for assembly, and showing a tool for facilitating assembly.

The depicted supports 32 each preferably include a flexible ball chain 42 and a support connector 44 (see FIGS. 1 and 2). Each ball chain 42 is elongated and presents opposite support ends 46. As will be described, the support connector 44 is configured to interconnect the support ends 46.

The ball chain 42 also preferably includes a series of spheroid ball connectors 48 and stem segments 50 (see FIG. 5). Each ball connector 48 is unitary and comprises a hollow spherical shell. The ball connectors 48 are generally spaced axially along the length of the ball chain 42.

Each stem segment 50 is unitary and presents opposite stem ends (not shown) received by respective ball connectors 48. The stem segments 50 preferably interconnect the ball connectors 48 and permit the ball connectors 48 to move relative to one another. Thus, each pair of adjacent ball connectors 48 are attached relative to one another by a stem segment 50.

The depicted stem segments 50 permit relative movement between adjacent pairs of ball connectors 48. Specifically, each stem end of the stem segment 50 is inserted through openings 52 in the respective ball connectors 48 (see FIG. 5). The stem ends are oversized relative to the openings 52 in the ball connectors 48 so that the stem segment 50 and ball connector 48 form a joint 54 (see FIG. 5) restricting detachment of the ball connector 48 and stem segment 50.

Each joint 54 preferably permits the stem segment 50 to slide axially relative to the ball connector 48. At the same time, each joint 54 also permits the stem segment 50 and the ball connector 48 to swing off-axis relative to the axis of the stem segment through a limited range of swinging movement.

The support ends 46 of each support 32 are configured to be removably interconnected by the support connector 44 so that the support 32 becomes endless, when the ends 46 are interconnected by the connector 44. The support connector 44 comprises a ball chain connector presenting an opening 56 (see FIG. 2) that removably receives ball connectors 48 of respective support ends 46. The support connector 44 is sized to be removably engaged with the ball connectors 48. It will be appreciated that the support ends 46 are selectively interconnectable (e.g., when wearing the jewelry assembly 30).

As will be explained, each charm 34 is preferably removably attachable to the supports 32 by the snap-fit connection 36. Preferably, the ball connectors 48 provide respective attachment parts 38, which are operable to be attached to a corresponding clip part 40 associated with the charm 34. The attachment parts 38 are each relatively rigid to flex the clip part 40 as the attachment part 38 is coupled with the clip part 40. The attachment parts 38 are relatively rigid in the sense that the attachment parts 38 are preferably more rigid than the clip parts 40 (e.g., due to materials, construction, combinations thereof, etc.).

Although the attachment parts 38 are preferably provided in the form of the spheroid ball connector 48, it is within the scope of some aspects of the present invention for the attachment parts to have an alternative configuration. For instance, one or more attachment parts could present an alternative boss shape suitable for removable frictional engagement with the clip parts. Alternative boss shapes may include a cylinder, a disk, an elongated shape having a polygonal profile, etc. In such alternative embodiments, it is preferable that the boss shape and a socket shape are complemental, or are otherwise configured to be frictionally interengaged and/or removably interlocked.

Each attachment part 38 is preferably integrally provided as part of the support 32 so that the charms 34 are directly attached to the supports 32. However, one or more of the attachment parts could be alternatively associated with the supports 32. For instance, the jewelry assembly could have a series of attachment parts that are discrete from the ball chain and are attached thereto (rather than being integral with the ball chain). In such alternative embodiments, it will be understood that the attachment parts preferably cooperate with the clip parts associated with the charms to provide the snap-fit connection.

Also, for some aspects of the present invention, one or more supports may be associated with at least some clip parts. For instance, the attachment parts (such as the depicted ball connectors) may be associated with the charms, while the clip parts are associated with the supports. In such alternative embodiments, the clip parts may be integrally formed with the supports or provided as a discrete structure attached to the supports. Furthermore, not only do certain aspects of the present invention contemplate reversing the parts so that the clip parts are associated with the support and the attachment parts are associated with the charms, it is also possible to provide the support with both types of parts and the charms with one or both types of parts.

The ball chains 42 and support connectors 44 of the supports 32 are preferably formed at least partly of a metallic material (e.g., aluminum, steel, etc.). For some aspects of the present invention, the supports could include alternative materials (e.g., a synthetic resin material).

The principles of the present invention are equally applicable for the jewelry assembly to provide an alternative configuration of supports. For instance, as will be shown in subsequent embodiments, the jewelry assembly could include an alternative number of supports (e.g., a single support or more than two supports). As subsequent embodiments also illustrate, the jewelry assembly may include one or more supports having an alternative support construction.

Each charm 34 is preferably removably attachable to the supports 32 by the snap-fit connection 36, which includes the attachment part(s) 38 and the clip part(s) 40. As will be explained, the clip parts 40 are preferably associated with the charms 34. In the depicted embodiment, the charms 34 each preferably include a charm body 58 and one or more clip parts 40 (see FIGS. 5-7*b*). Each of the depicted charms 34 also presents a front surface 62, a back surface 64, and side surfaces 66 (see FIGS. 5-7*b*).

The jewelry assembly 30 is preferably configured so that the charms 34 may be arranged to cooperatively provide indicia 35 extending along the supports 32. The front surfaces 62 and side surfaces 66 comprise continuous, flat surfaces that form corresponding parts of the indicia 35. It is also within the ambit of the present invention for one or more of the front surfaces and/or side surfaces 66 to include alternative surface features (e.g., to provide desired elements of the indicia 35).

Figure 6:
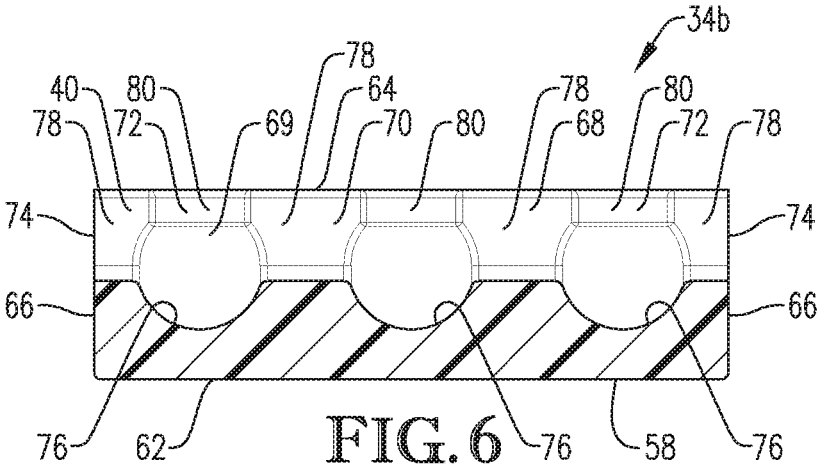
FIG. 6 is a cross section of one of the charms taken along line 6-6 in FIG. 5, showing one of the clip arms defining in part a slot and neck of the charm.

The illustrated clip parts 40 each preferably include a pair of elongated opposed clip arms 68 that define an overall opening 69 (see FIGS. 6-7*b*). The opening 69 preferably includes a slot 70 extending between the clip arms 68 (see FIGS. 6-7*b*). As will be described below, the clip arms 68 are preferably configured to be in frictional gripping engagement with the attachment parts 38. However, it is also consistent with the scope of some aspects of the present invention for frictional engagement between parts 38,40 not to be required (e.g., where the clip parts and attachment parts are releasably interlocked). The clip parts 40 are also configured to flex (see FIG. 7*b*), particularly during attachment of the clip parts 40 to attachment parts 38.

The clip arms 68 of each clip part 40 cooperatively define the slot 70 and a neck 72 (see FIGS. 6-7*b*). The depicted neck 72 preferably intersects the back surface 64 of the corresponding charm 34. The slot 70 preferably extends along the neck 72 and intersects the side surfaces 66 to define slot ends 74 (see FIGS. 6-7*b*). However, as shown in a subsequent embodiment, at least some slots may be configured to extend alternatively relative to surfaces of the charm.

Although the clip parts 40 are integrally formed as part of respective charms 34, one or more clip parts could be discrete from the charms 34.

As depicted, the charms 34*b*,34*c*,34*d*,34*e*,34*f* present a single slot 70, while charms 34*a* present a pair of slots 70. It is within the scope of the present invention for a charm to present more than two slots (as will be illustrated in a subsequent embodiment). For certain aspects of the present invention, at least one of the charms could be devoid of a slot (e.g., if the charm is supported by one or more other charms).

Each clip part 40 of the charms 34 also preferably presents at least one spheroid socket 76. As will be explained, each socket 76 is configured to be removably attached to a respective ball connector 48.

In the depicted embodiment, the sockets 76 are formed as part of a corresponding slot 70. Each slot 70 also preferably includes narrow slot sections 78 that extend along the length of the charm to intersect adjacent sockets 76 (see FIGS. 5 and 6). Each socket 76 is preferably spaced between the slot ends 74. As depicted in a subsequent embodiment, at least some sockets may not be connected to an adjacent socket by a slot section.

The charms 34*a*,34*c*,34*d*,34*e* include a slot 70 with a single socket 76 (see FIGS. 2 and 5). The charms 34*b*,34*f* include a slot 70 with multiple sockets 76 arranged along the length of the slot 70 (see FIGS. 2 and 5). As noted, for slots 70 having multiple sockets 76, each pair of adjacent sockets 76 is preferably joined by a narrow slot section 78.

Each socket 76 defines a slot dimension D1 corresponding to the socket diameter (see FIG. 7*a*). The slot sections 78 preferably define a slot dimension D2 narrower than the slot dimension D1 (see FIG. 7*a*). Preferably, the neck 72 defines a gap 80 having a cross-sectional gap dimension D3 that is narrower than the slot dimension D1 (see FIG. 7*a*).

As will be described, each charm 34 is preferably removably attachable to the supports 32 by the snap-fit connection 36. Preferably, the charms 34 each include a clip part 40 operable to be attached to a corresponding attachment part 38 of the supports 32.

Although the clip parts 40 are preferably provided in the form of the clip arms 68, it is within the scope of some aspects of the present invention for the clip parts 40 to have an alternative configuration. In alternative embodiments, one or more clip parts may have alternative clip arms suitable for engagement with the respective attachment parts. One or more clip arms may be alternatively shaped and/or positioned relative to one another (e.g., to facilitate connection with the attachment parts).

Alternative embodiments of the clip parts may present an alternative socket shape suitable for removable engagement with the attachment parts. Alternative socket shapes may include a cylinder, a disk, an elongated shape having a polygonal profile, etc. In such alternative embodiments, it is preferable that the socket shape and a boss shape associated with the attachment part are complemental, or are otherwise configured to be frictionally interengaged and/or removably interlocked.

Although the clip parts 40 are an integral part of the charms 34, the clip parts could be alternatively associated with the charms. For instance, the jewelry assembly could have one or more clip parts that are discrete from the charms and are attached thereto (rather than being integrated with the charms). In such alternative embodiments, it will be understood that the clip parts cooperate with the attachment parts associated with the supports to provide the snap-fit connection.

As also noted above, for some aspects of the present invention, the charms could be associated with at least some attachment parts, whether the attachment parts are integrally formed with the charms or are provided as a discrete structure attached to the charms.

The charms 34 preferably include a flexible material that facilitates flexing of the charms 34 and particularly the clip parts 40 (see FIG. 7*b*). The charms 34 are preferably formed at least partly of a synthetic resin material that facilitates flexing. The synthetic resin material preferably includes an acrylonitrile butadiene styrene (ABS) material or another material having a styrene mix. Other materials may be used to form the charm without departing from the scope of the present invention. For instance, the charm could include metallic materials (e.g., aluminum and/or steel), wood, glass, etc. Embodiments of the charm may also include one or more materials applied as a coating to an underlying substrate. One or more of the above-referenced materials may be included to provide a desired structural characteristic of the charm (e.g., to provide the charm with suitable flexibility). It will also be understood that one or more materials may be included to provide the charm with a desired surface ornamentation.

An ABS material is preferably suitable to form the charm using an injection molding process, although other synthetic resin materials (or other materials) may be used to form the charm by injection molding. It will also be appreciated that the charm may be formed by other plastic molding processes. For certain aspects of the present invention, the charm may also be constructed of other materials and/or by manufacturing methods other than molding (e.g., by milling, cutting, extrusion, machining, welding, or adhering of components).

Flexibility of the supports and charms may be reversed according to some aspects of the present invention, such that the ball connector flexes (compresses) and the clip arms are relatively rigid.

Again, each charm 34 is removably attachable to the supports 32 by a snap-fit connection 36. The attachment parts 38 associated with the supports 32 are removably received by the clip parts 40 associated with the charms 34. In particular, the ball connectors 48 provided by the attachment parts 38 are removably received in the sockets 76 presented by the clip parts 40.

The charms 34*b*,34*c*,34*d*,34*e*,34*f* are preferably attached to one of the supports 32. The charms 34*a* are preferably attached to and interconnect both supports 32.

In the depicted embodiment, the charms 34 are preferably configured so that a particular combination of slots 70 are substantially coaxially aligned with one another (see FIG. 2). For example, the slots 70 receiving support 32*a* are substantially coaxially aligned with each other. Similarly, the slots 70 receiving support 32*b* are substantially coaxially aligned with each other. In this manner, as the supports 32 are tensioned, the charms 34 are configured to remain in alignment with each other. However, as will be shown in a subsequent embodiment, the slots of charms mounted on a common support may be off-axis relative to the axis of the support.

The clip parts 40 are preferably flexible so as to flex as the attachment part 38 passes through the neck 72 into the slot 70. In particular, the clip part 40 is flexible to permit yieldable flexing of the clip arms 68 away from each other to expand the gap 80 (see FIG. 7*b*), particularly as the attachment part 40 passes through the neck 72. Furthermore, the attachment part 38 is relatively rigid to flex the clip arms 68 away from each other to expand the gap 80. The gap 80 is expanded so that the ball connector 48 can move through the gap 80 and into the socket 76. In the depicted embodiment, the entire charm 34 is preferably flexible to facilitate yieldable flexing of the clip arms 68 away from each other.

When the clip part 40 of the charm 34 is attached to the attachment part 38 of the support 32, at least one of the clip arms 68 is flexed by the attachment part 38 so that the clip arms 68 are in frictional gripping engagement with the attachment part 38. Most preferably, both of the clip arms 68 may be flexed by the attachment part 38. Consistent with at least some aspects of the present invention, frictional engagement between the attachment parts 38 and the clip parts 40 may not be required. In alternative embodiments, the attachment parts 38 and the clip parts 40 may be releasably interlocked with one another without being frictionally engaged. For instance, it will be understood that the ball connectors are oversized relative to the gap presented by the neck, and such interlocking engagement between the attachment and clip parts is configured to restrict uncoupling without the parts being frictionally engaged.

A tray 82 is preferably provided to facilitate assembly of the supports 32 and charms 34. The tray 82 includes a raised outer margin 84 and a recessed channel 86 (see FIG. 4). The outer margin 84 presents slotted openings 88 that are shaped to receive the support ends 46 (see FIG. 4).

In preferred embodiments, the supports 32 and charms 34 are assembled by first mounting the ball chains 42 on the tray 82. In particular, the support ends 46 are located in the openings 88 so that the ball chains 42 are generally straight. The ball chains 42 may be under no tension or under slight tension when mounted on the tray 82.

The charms 34 are then brought into engagement with the supports 32 by lowering the charms 34 onto the ball chains 42 with the front surfaces 62 facing upwardly. This preferred orientation of the charms 34 permits the user to see the indicia 35 as the indicia 35 is being formed during assembly.

The charms 34 are arranged so that the necks 72 are brought into contact with the ball connectors 48, and the ball connectors 48 extend across respective gaps 80. Contact between the ball connectors 48 and necks 72 may occur as the sockets 76 are aligned with ball connectors 48. The ball connectors 48 and necks 72 may come into contact where at least some misalignment exists between the ball connectors 48 and the sockets 76. However, due to the configuration of the ball connectors 48 and the necks 72, the ball connectors 48 and the necks 72 can self-align to facilitate insertion of the ball connectors 48 relative to the sockets 76. For instance, the depicted ball connectors 48 and necks 72 present rounded surfaces that are configured to urge the ball connectors 48 into alignment.

With the sockets 76 being aligned with respective ball connectors 48, the user can selectively press the charms 34 downwardly so that the ball connectors 48 are secured within the sockets 76 (see FIG. 5). As the charms 34 are pressed downwardly, the ball connector 48 flexes the clip arms 68 away from each other to expand the gap 80. The gap 80 is expanded so that the ball connector 48 can move through the gap 80 and into the socket 76.

It will be understood that the charms 34 can be attached to the supports 32 at different times (e.g., where the charms are attached sequentially relative to one another). However, multiple charms 34 can also be attached to the supports 32 at the same time.

In some situations, the ball connectors 48 may not be snapped completely into the socket 76 by pressing on the charm 34 (e.g., due to friction between the ball connector 48 and the neck 72). For situations where the ball connector 48 is at least partly stuck within the neck 72, a tool 90 (see FIG. 4) may be used to manually push against the ball connector 48 from adjacent the back surface 64 to move the ball connector 48 through the gap 80 and into the socket 76. To gain access to the back surface 64, it will be understood that the supports 32 may need to be removed from the tray 82.

Turning to FIGS. 8-21, alternative embodiments of the present invention are depicted. For the sake of brevity, the remaining description will focus primarily on the differences of these alternative embodiments from the preferred embodiment described above.

Referring to FIGS. 8-10, alternative jewelry assemblies 200,202,204 are depicted. The jewelry assemblies 200,202, 204 include supports 206 and alternative charms 208. Each support 206 includes a ball chain 210 similar to ball chain 42 of the first embodiment and provides integral attachment parts 212.

The charms 208 are configured for attachment to one or both of the ball chains 210 and preferably include integral clip parts (not shown) to receive respective attachment parts 212. Although not shown, the clip parts preferably present slots with spheroid sockets, a neck (with a gap), and slot segments similar to the slots 70 of the first embodiment. The sockets, necks, and slot segments of the charms 208 are positioned and oriented to correspond to the position and arrangement of the depicted ball chains 210. The attachment parts (i.e., the ball connectors) of the ball chains 210 depicted in dashed lines are received in corresponding slots of the charms 208.

Turning to FIG. 11, an alternative jewelry assembly 300 is configured to provide a necklace. The jewelry assembly 300 includes supports 302*a,b*, support connectors 304, and alternative charms 306. Each support 302*a,b* includes a ball chain 308 similar to ball chain 42 and provides integral attachment parts 310. The supports 302*a* present respective support ends 312 that are attached to and extend between a pair of support connectors 304. The supports 302*b* are attached to and extend from the support connectors 304 and provide chain extensions to extend around the back of the wearer's neck.

The charms 306 and the support connectors 304 are configured for attachment to each of the ball chains 308. The charms 306 preferably include integral clip parts (not shown) to receive respective attachment parts 310. The support connectors also include clip parts similar to charms. Again, the clip parts preferably present slots (not shown) with spheroid sockets, narrowed necks, and slot segments. The sockets, necks, and slot segments of the charms 306 (and the support connectors 304) are positioned and oriented to correspond to the illustrated position and arrangement of the depicted ball chains 308. Parts of the ball chains 308 depicted in dashed lines are received in corresponding slots of the charms 208.

Referring to FIG. 12, an alternative jewelry assembly 400 include supports 402 and alternative charms 404. Each support 402 includes a ball chain 406 and attachment parts 408.

The charms 404 are configured for attachment to one or both of the ball chains 406 and preferably include integral clip parts (not shown) to receive respective attachment parts 408. Parts of the ball chains 406 depicted in dashed lines are received in corresponding slots of the charms 404.

The sockets and slot segments of the charms 404 are positioned and oriented to correspond to the position and arrangement of the depicted ball chains 406. In contrast to the previous embodiment, the charms 404 are configured so that the slots are not positioned along a linear path or longitudinal axis. It will be appreciated that some adjacent sockets are offset relative to a longitudinal direction of extension of the support, arranged, in a curvilinear path, etc. As a result, the support 402 assumes a generally nonlinear shape.

Turning to FIG. 13, an alternative jewelry assembly 500 is provided as part of a larger jewelry arrangement. The jewelry assembly 500 preferably includes alternative supports 502 and alternative charms 504. Each support 502 comprises a unitary structure with opposite spheroid ball connectors 506 and a support segment 508 extending between the ball connectors 506. The ball connectors 506 preferably provide attachment parts 510 associated with the support 502.

The charms 504 are configured for attachment to respective supports 502 and include clip parts 512. Each clip part 512 includes opposed clip arm segments 514 configured to be interconnected (and preferably frictionally interengaged) with the attachment parts 510.

The clip parts 512 preferably present slots 516*a,b* that define respective spheroid sockets 518. The depicted slots 516*a* preferably include slot segments 520 on both sides of and intersecting the adjacent sockets 518. The slots 516*b* preferably include a single slot segment 520 intersecting the respective socket 518. The clip parts 512 each present a neck 522 associated with each slot 516. The neck 522 presents a gap 524 having cross-sectional gap dimension.

As illustrated, the depicted jewelry assembly 500 may be provided with charms 504 with various numbers and arrangements of clip parts 512. The charms 504 are variously shaped and configured with clip parts 512 to facilitate a web-type arrangement of charms 504. That is, the charms 504 can be interconnected so as to be positioned relative to one another along more than one axis.

Turning to FIGS. 14 and 15, alternative jewelry assemblies 600,602 include features similar to the jewelry assembly 500, but form different jewelry arrangements. The jewelry assembly 600 generally takes the form of a necklace, while the jewelry assembly 600 includes a bracelet. The assemblies 600 each include supports 604 and alternative charms 606.

The supports 604 are similar to supports 502 and illustrate the use of supports with various length dimensions. The charms 606 are each configured for attachment to respective supports 604 and include clip parts similar to the clip parts 512.

Again, the charms 606 are variously shaped and configured with clip parts to facilitate a web-type arrangement of charms 606. Thus, the charms 606 can be interconnected so as to be positioned relative to one another along more than one axis. Parts of the supports 604 depicted in dashed lines are received in corresponding slots of the charms 606.

Turning to FIGS. 16-21, an alternative jewelry assembly 700 includes elongated supports 702 and a plurality of charms 704. The jewelry assembly 700 is preferably configured so that the charms 704 cooperatively provide indicia (not shown).

Each charm 704 is removably attachable to the supports 702 by an alternative snap-fit connection 706 (see FIG. 17). Each snap-fit connection 706 preferably includes an attachment part 708 and a clip part 710 (see FIG. 17). The attachment parts 708 are associated with the supports 702, and the clip parts 710 are associated with the charms 704, although some aspects of the present invention contemplate reversing this arrangement, as noted above.

The depicted supports 702 each preferably include a flexible elastic band 712 and a support connector 714. Each band 712 is elongated and presents opposite support ends 716. The support connector 714 is operable to be crimped onto the support ends 716 to interconnect the support ends 716. The band 712 presents a substantially continuous band surface 718 that defines the attachment part 708 and presents a cross-sectional band dimension D4 (see FIG. 18). The principles of the present invention are also applicable to supports formed of a continuous band without the need for or use of a support connector. In this alternative, the band surface would be fully continuous.

Each charm 704 is preferably removably interconnected with the supports 702 by the snap-fit connection 706. As will be explained, the attachment parts 708 (the portion of the band 712 directly engaging the clip part 710) are each relatively flexible so that the attachment part flexes when engaging the clip part 710. In particular, the attachment part 708 is elastically compressible so that the band dimension D4 is temporarily reduced as the attachment part 708 passes through a neck of the charm 704.

Each attachment part 708 is preferably integrally provided as part of the support 702 so that the charms 704 are directly attached to the supports 702. However, as explained previously, one or more of the attachment parts could be alternatively associated with the supports 32.

Again, for some aspects of the present invention, one or more supports 702 may be provided with at least some clip parts. For instance, the attachment parts may be associated with the charms, while the clip parts are associated with the supports. In such alternative embodiments, the clip parts may be integrally formed with the supports or provided as a discrete structure attached to the supports.

The bands 712 of the supports 702 are preferably formed at least partly of an elastomeric material, such that the bands 712 can be yieldably stretched and compressed. For instance, the bands 712 may include a synthetic resin material having elastomeric properties, although the band could include other materials for some aspects of the present invention.

The principles of the present invention are equally applicable for the jewelry assembly to provide an alternative configuration of supports. For instance, the jewelry assembly could include an alternative number of supports (e.g., a single support or more than two supports). Alternative embodiments may include one or more supports having an alternative cross-sectional profile (e.g., a polygonal, splined, grooved, etc.) other than a circular profile, with the slot preferably being complementally shaped.

In the depicted embodiment, the charms 704 each preferably include a charm body 720 and an integrally formed clip part 710 (see FIGS. 16 and 17). The illustrated clip parts 710 each preferably include a pair of opposed clip arms 722 (see FIG. 17).

The clip arms 722 each preferably present an open slot 724 and a neck 726 (see FIGS. 18 and 19). Although the clip parts 710 are integrally formed as part of respective charms 704, one or more clip parts could be discrete from the charms. Each slot 724 defines a slot dimension D1 corresponding to the slot diameter (see FIG. 18). Preferably, the neck 726 defines a gap 728 having a cross-sectional gap dimension that is narrower than the slot dimension D1 (see FIG. 18). The clip arms 722 are configured to be in frictional gripping engagement with the attachment part 708 so that the clip arms 722 cooperatively compress the attachment part 708, when the attachment part 708 is received in the slot 724. However, according to some aspects of the present invention, frictional interengagement between the attachment and clip parts when fully coupled is not required. For example, the band 712 may be resiliently compressed as it passes through the neck 726 and then alternatively returned to an unflexed condition when received in the slot 724. That is, the band 712 may alternatively fit "loosely" in the slot 724.

Although the clip parts 710 are an integral part of the charms 704, the clip parts could be alternatively associated with the charms. As noted above, the jewelry assembly could have one or more clip parts that are discrete from the charms and are attached thereto (rather than being integrated with the charms).

Also, for some aspects of the present invention, the charms could be associated with at least some attachment parts, whether the attachment parts are integrally formed with the charms or are provided as a discrete structure attached to the charms.

The charms 704 preferably include a relatively rigid material that facilitates flexing of the attachment parts and is particularly configured to elastically compress the attachment parts. For instance, the charms may include a relatively rigid synthetic resin material.

Other materials may be used to form the charm without departing from the scope of the present invention. For instance, the charm could include metallic materials (e.g., aluminum and/or steel), wood, glass, etc. Again, embodiments of the charm may also include one or more materials applied as a coating to an underlying substrate. One or more of the above-referenced materials may be included to provide a desired structural characteristic of the charm (e.g., to provide the charm with suitable flexibility). It will also be understood that one or more materials may be included to provide the charm with a desired surface ornamentation.

The bands 712 are preferably elastically compressible so that the band dimension D4 is temporarily reduced as the attachment part 708 passes through the neck 726 into the slot 724. In particular, the clip arms 722 yieldably compress a portion of the band 712 so that the band 712 passes through the neck 726. The clip part 710 is relatively rigid to yieldably compress the band.

When the clip part 710 of the charm 704 is attached to the attachment part 708 of the support 702, the band 712 is in frictional engagement with the slot 724 of the clip arms 722. Furthermore, the portion of the band 712 received by the clip arms 722 is preferably oversized relative to the slot dimension D1 so that the portion of the band 712 remains in a compressed condition when located in the slot 724. For some aspects of the present invention, the band 712 could be frictionally engaged by the clip arms 722 without being meaningfully compressed (that is, the band 712 and slot 724 are complementally sized and shaped to provide only frictional contact therebetween).

Turning to FIGS. 18-21, the jewelry assembly 700 is configured to be assembled using a charm attachment device 730. The charm attachment device 730 includes a cylindrical tray 732 and a lever 734. The tray 732 comprises an endless structure and includes a base 736 and a curved guide member 738. The base 736 includes a tab **736*a* and guide ribs 740 (see FIG. 18). The lever 734 also includes a tab 734*a*. The base 736 and the lever 734 are swingably interconnected by a hinge 742, which permits the lever 734 to swing between open and closed positions. The tabs 734*a*, 736*a* are operable to be grasped and moved relative to each other to facilitate swinging of the lever 734 between the open and closed positions. The guide member 738 extends circumferentially and presents a support surface 744 and a pair of grooves 746. The grooves 746 intersect the surface 744 and extend circumferentially to receive the bands 712 (see FIG. 18**).

Prior to beginning assembly of the jewelry, the lever 734 is located in an open position to expose the base 736 (see FIG. 18). In preferred embodiments, the supports 702 and charms 704 are assembled by first mounting the bands 712 on the tray 732 at least partly within the grooves 746 (see FIG. 19). When received by the grooves 746, the bands 712 may be under no tension or under slight tension.

The charm attachment device 730 is operable to snap one of the charms 704 into engagement with the bands 712. The device 730 is preferably configured to snap the charms 704 sequentially into engagement with the bands 712. For some aspects of the present invention, the charm attachment device could also be configured to snap multiple charms 704 onto the bands 712 at the same time.

To snap a charm 704 onto the bands 712, the charm 704 is initially brought into engagement with the supports 702 by lowering the charm 704 onto the bands 712 (see FIG. 19). Preferably, the charm 704 is lowered into a position laterally between the guide ribs 740.

The charms 704 are arranged so that the necks 726 are brought into contact with the band surfaces 718, and the bands 712 extend across respective gaps 728 (see FIG. 19). Contact between the bands 712 and necks 726 may occur as the slots 724 are aligned with the bands 712. The bands 712 and necks 726 may come into contact where at least some misalignment exists between the bands 712 and the slots 724. However, due to the configuration of the bands 712 and the necks 726, the bands 712 and the necks 726 can self-align to facilitate connection.

With the slots 724 being aligned with respective bands 712, the user selectively swings the lever 734 toward the closed position to press the charm 704 downwardly and snap the charm 704 into attachment with the bands 712 (see FIG. 20). As the charm 704 is pressed downwardly, the clip arms 722 elastically compress the band 712 so that the band 712 moves through the gap 728 and into the slot 724.

The lever 734 may be swung open to permit attachment of another charm 704 or once assembly of the jewelry is complete. With the lever 734 opened, the user may slide the attached charm 704 to a location on the support surface 744 of the guide member 738, on either side of the base 736. Alternatively, the base 736 may be repositioned along the bands 712 (e.g., by shifting the bands 712 circumferentially about the guide member 738, particularly if the frictional interengagement between the charm 704 and bands 712 significantly inhibits sliding of the charm). Once the attached charm 704 or base 736 is relocated, the next charm 704 may be lowered into engagement with the bands 712 between the guide ribs 740. Again, the lever 734 is preferably swung closed to snap the charm 704 into attachment with the bands 712.

Although the above description presents features of preferred embodiments of the present invention, other preferred embodiments may also be created in keeping with the principles of the invention. Such other preferred embodiments may, for instance, be provided with features drawn from one or more of the embodiments described above. Yet further, such other preferred embodiments may include features from multiple embodiments described above, particularly where such features are compatible for use together despite having been presented independently as part of separate embodiments in the above description.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

The invention claimed is:

1. A jewelry assembly comprising:

an elongated support; and a plurality of charms, each being removably attachable to the support by a snap-fit connection comprising attachment and clip parts, with one of the parts being associated with the support and the other of the parts being associated with the charm, said clip part including a pair of opposed clip arms that present an open slot and a neck with a gap having a narrower cross-sectional dimension than the slot, said attachment part being received in the slot and having a cross-sectional dimension greater than the gap of the neck, with at least one of the attachment and clip parts being flexible so as to flex as the attachment part passes through the neck into the slot, said support including an elongated support body and a support connector, said support body presenting opposite ends, said support connector interconnecting the ends so that the support is endless.

2. The jewelry assembly as claimed in claim 1, said clip part being flexible to permit yieldable flexing of the clip arms away from each other to expand the gap, said attachment part being relatively rigid to flex the clip arms away from each other to expand the gap as the attachment part passes through the neck.

3. The jewelry assembly as claimed in claim 2, said clip part being associated with the charm and said attachment part being associated with the support.

4. The jewelry assembly as claimed in claim 2, at least one of said clip arms being flexed by the attachment part so that the clip arms are in frictional gripping engagement with the attachment part, when the attachment part is received within the slot.

5. A jewelry assembly comprising:

an elongated support; and a plurality of charms, each being removably attachable to the support by a snap-fit connection comprising attachment and clip parts, with one of the parts being associated with the support and the other of the parts being associated with the charm, said clip part including a pair of opposed clip arms that present an open slot and a neck with a gap having a narrower cross-sectional dimension than the slot, said attachment part being received in the slot and having a cross-sectional dimension greater than the gap of the neck, with at least one of the attachment and clip parts being flexible so as to flex as the attachment part passes through the neck into the slot, said clip part being flexible to permit yieldable flexing of the clip arms away from each other to expand the gap, said attachment part being relatively rigid to flex the clip arms away from each other to expand the gap as the attachment part passes through the neck, said clip part being associated with the charm and said attachment part being associated with the support, said clip part being integrally formed as part of the charm, with the charm being flexible to facilitate yieldable flexing of the clip arms away from each other.

6. The jewelry assembly as claimed in claim 5, said attachment part being integrally formed as part of the support so that the charm is directly attached to the support.

7. The jewelry assembly as claimed in claim 6,
said support comprising an elongated ball chain with a series of spheroid ball connectors,
each of said charms presenting a spheroid socket removably attached to a respective ball connector.

8. A jewelry assembly comprising:
an elongated support; and
a plurality of charms, each being removably attachable to the support by a snap-fit connection comprising attachment and clip parts, with one of the parts being associated with the support and the other of the parts being associated with the charm,
said clip part including a pair of opposed clip arms that present an open slot and a neck with a gap having a narrower cross-sectional dimension than the slot,
said attachment part being received in the slot and having a cross-sectional dimension greater than the gap of the neck, with at least one of the attachment and clip parts being flexible so as to flex as the attachment part passes through the neck into the slot,
said attachment part being flexible and said clip part being relatively rigid to restrict movement of the clip arms relative to each other,
said attachment part being elastically compressible so that the cross-sectional dimension is temporarily reduced as the attachment part passes through the neck.

9. The jewelry assembly as claimed in claim 8,
said clip part being associated with the charm and said attachment part being associated with the support.

10. The jewelry assembly as claimed in claim 9,
said clip part being integrally formed as part of the charm, with the charm being relatively rigid to facilitate compression of the attachment part.

11. The jewelry assembly as claimed in claim 10,
said attachment part being integrally formed as part of the support so that the charm is directly attached to the support.

12. The jewelry assembly as claimed in claim 11,
said support comprising a continuous elastic band.

13. The jewelry assembly as claimed in claim 8,
said clip arms being in frictional gripping engagement with the attachment part so that the clip arms cooperatively compress the attachment part, when the attachment part is within the slot.

14. A jewelry assembly comprising:
an elongated support;
a plurality of charms, each being removably attachable to the support by a snap-fit connection comprising attachment and clip parts, with one of the parts being associated with the support and the other of the parts being associated with the charm,
said clip part including a pair of opposed clip arms that present an open slot and a neck with a gap having a narrower cross-sectional dimension than the slot,
said attachment part being received in the slot and having a cross-sectional dimension greater than the gap of the neck, with at least one of the attachment and clip parts being flexible so as to flex as the attachment part passes through the neck into the slot; and
a plurality of supports,
at least one of said charms interconnecting an adjacent pair of the supports.

15. The jewelry assembly as claimed in claim 14,
each charm and support including a pair of the attachment and clip parts.

16. The jewelry assembly as claimed in claim 15,
said clip parts being associated with the charms and said attachment parts being associated with the supports.

17. The jewelry assembly as claimed in claim 16,
said clip parts being integrally formed as part of the charms and said attachment parts being integrally formed as part of the supports,
said supports each comprising an elongated ball chain with a series of spheroid ball connectors,
each of said charms presenting a spheroid socket removably attached to a respective ball connector.

18. The jewelry assembly as claimed in claim 14,
said clip part being flexible to permit yieldable flexing of the clip arms away from each other to expand the gap,
said attachment part being relatively rigid to flex the clip arms away from each other to expand the gap as the attachment part passes through the neck.

* * * * *